US006568339B1

(12) United States Patent
Campbell et al.

(10) Patent No.: US 6,568,339 B1
(45) Date of Patent: May 27, 2003

(54) SIDE MOUNT THREAD WIPER FOR A SEWING MACHINE

(75) Inventors: Kirk Brian Campbell, Hewitt, NJ (US); Peter Schueler, Hawthorne, NJ (US)

(73) Assignee: Clinton Indusries, Inc., Carlstadt, NJ (US)

( * ) Notice: Subject to any disclaimer, the term of this patent is extended or adjusted under 35 U.S.C. 154(b) by 0 days.

(21) Appl. No.: 09/605,305

(22) Filed: Jun. 28, 2000

(51) Int. Cl.[7] ..... D05B 65/00
(52) U.S. Cl. ..... 112/286
(58) Field of Search ..... 112/286, 301, 112/293, 253, 310, 237, 238, 239

(56) References Cited

U.S. PATENT DOCUMENTS

| | | | | |
|---|---|---|---|---|
| 3,494,316 A | | 2/1970 | Ross | |
| 3,847,102 A | * | 11/1974 | Rogner | 112/286 |
| 4,173,193 A | | 11/1979 | Morinaga et al. | |
| 4,370,940 A | * | 2/1983 | Melzer et al. | 112/286 |
| 4,422,397 A | | 12/1983 | Papajewski et al. | |
| 4,436,044 A | * | 3/1984 | Nordstrom et al. | 112/286 |
| 4,550,672 A | | 11/1985 | Kastrup | |
| 4,706,588 A | * | 11/1987 | Fujikawa | 112/286 |
| 4,829,922 A | * | 5/1989 | Lohe | 112/310 |
| 5,025,739 A | * | 6/1991 | Inoue | 112/253 X |
| 5,044,290 A | * | 9/1991 | Sato et al. | 112/286 |
| 5,144,901 A | | 9/1992 | Suzuki | |

FOREIGN PATENT DOCUMENTS

| | | | | |
|---|---|---|---|---|
| GB | 2006283 | | 5/1979 | D05B/65/00 |
| JP | 5221930 | * | 6/1977 | 112/286 |
| JP | 59-71773 | | 4/1984 | D05B/65/06 |
| JP | 2001170387 | | 6/2001 | D05B/65/06 |

* cited by examiner

*Primary Examiner*—Ismael Izaguirre
(74) *Attorney, Agent, or Firm*—Darby & Darby

(57) ABSTRACT

A thread wiper assembly mountable to the side of a sewing machine. The thread wiper assembly is particularly advantageous with sewing machines that are equipped with a walking foot. The thread wiper is mounted sidewardly relative to the needle and includes a picker arm, that while in a retracted position, is disposed sidewardly relative to the needle and out of its path of travel. Because the thread wiper is mounted to the side of the sewing machine and sidewardly relative to the needle, the picker arm is able to traverse along a path between the needle and the walking foot without interference. An actuating member: (i) lowers the picker arm in a direction substantially parallel to the needle until a free end of the picker arm is at a level between the needle and the walking foot; (ii) sidewardly thrusts the picker arm at a first angle, relative to a vertical axis, towards the needle along a path between the needle and the walking foot without interference; (iii) advances further sideways the picker arm at a second angle, relative to the vertical axis, greater than the first angle; and (iv) retracts away while raising the picker member in a reverse movement to complete the cycle. The thread wiper may include a microprocessor that is programmed to intelligently disable/enable the thread wiper depending on such factors as the adjustment in rise of the walking foot and/or whether the turn back operation of the sewing machine is activated. The thread wiper assembly is also suitable for use with a sewing machine that does not have a walking foot.

42 Claims, 8 Drawing Sheets

SIDE MOUNT THREAD WIPER FOR A SEWING MACHINE

BACKGROUND OF THE INVENTION

1. Field of the Invention

The present invention relates generally to sewing machines and, in particular, to an improved side mount thread wiper installed in a sewing machine for withdrawing the severed thread from the path of the work piece following the application of a line of stitching.

2. Description of Related Art

In performing commercial sewing operations, it is necessary for maximum economy and efficiency to minimize the number of time-consuming hand operations. Among such time consuming manually performed operations is the removal of the excess or leftover severed thread, e.g. the tail, from the path of a work piece following completion of a sewing sequence so as to facilitate the unhindered performance of the sewing sequence for the next work piece. A thread-wiping or retracting mechanism pulls the excess thread above the presser foot so that the needle carries the tail below the presser foot and sews the tail in with the next stitch. Accordingly, the top surface of the next work piece is free from loose threads.

U.S. Pat. No. 3,901,171 discloses a thread wiper mounted behind the needle. Under normal sewing conditions the thread wiper is in a raised position rearwardly of the needle so as to be outside of the sewing or operating space of the sewing machine. Upon completion of a sewing stitch the needle is stopped in its fully raised position at which point the thread is cut. The thread wiper is thereafter lowered and passes between the needle and foot piece, whereupon the picker arm is swung across the path of the needle displacing the thread laterally. This thread wiper mechanism, however, is not suitable for use with heavy duty sewing machines that are used to sew heavier gauge materials, for example, carpet or upholstery, and include a walking foot synchronized with the needle during the stitching operation. An example heavy duty sewing machine is Model 767 manufactured by Durkopp Adler Ag. The distance between the walking foot and needle in such heavy duty sewing machines is too small to accommodate conventional thread wiper mechanisms.

It is therefore desirable to develop a thread wiper mechanism that is suitable for use with a heavy duty sewing machine having a walking foot.

SUMMARY OF THE INVENTION

The present invention is directed to an assembly for use with a sewing machine including a thread wiper adapted to be mountable to the side of the sewing machine.

In addition the invention relates to a thread wiper for use in a sewing machine having a needle reciprocatable along a path between a raised position and a lowered position. The thread wiper is mounted sidewardly relative to the needle and includes a picker arm, that while in a retracted position, is disposed sidewardly relative to said needle. Also included in the thread wiper is an actuating member supporting the picker arm. The actuating member performs the following operations: lowers the picker arm in a direction substantially parallel to the needle until a free end of the picker arm is at a level between the needle and the walking foot; sidewardly thrusts the picker arm at a first angle, relative to a vertical axis, towards the needle along a path between the needle and the walking foot without interference; advances further sideways the picker arm at a second angle, relative to the vertical axis, greater than the first angle; and retracts away while raising the picker member in a reverse movement to complete the cycle. In an alternative embodiment the same system can be used with a sewing machine that does not have a walking foot, but instead only has a presser foot.

Furthermore, the invention is directed to a method for cyclically operating the assembly described above. Initially, the picker arm is lowered in a direction substantially parallel to the needle until the free end of the picker arm is at a level between the needle and the walking foot. The picker arm is thrust sidewardly at a first angle, relative to a vertical axis, towards the needle along a path between the needle and the walking foot without interference. After being thrust sideward, the picker arm is advanced towards the needle at a second angle, relative to the vertical axis, greater than the first angle. Thereafter, the picker arm is retracted while being raised in a reverse movement to complete the cycle. As mentioned above with respect to the assembly, the method for operating the assembly may be performed when installed in a sewing machine that does not have a walking foot.

Another aspect of the invention is directed to an intelligent thread wiper for use with a sewing machine including a walking foot. The thread wiper includes a microprocessor for disabling (turning off) the thread wiper when the walking foot is set to a value greater than a predetermined percentage of a maximum permitted rise and/or the turn back operation of the sewing machine is disabled (turned off). Alternatively, the microprocessor may be programmed to enable (turn on) the thread wiper when the walking foot is set to a value less than a predetermined percentage of a maximum permitted rise and the turn back operation of the sewing machine is enabled (turned on).

In yet another embodiment the intelligent thread wiper may be used with a sewing machine that does not include a walking foot wherein the microprocessor is programmed to disable (turn off) the thread wiper when the turn back operation of the sewing machine is disabled (turned off). Conversely, the microprocessor may be programmed to enable (turn on) the thread wiper when the turn back operation of the sewing machine is enabled (turned on).

The invention is also directed to a sewing machine including a needle, a thread wiper mountable sidewardly relative to the needle and arranged so as not to interfere with the needle, and an end face plate covering the thread wiper.

BRIEF DESCRIPTION OF THE DRAWING

The foregoing and other features of the present invention will be more readily apparent from the following detailed description and drawings of illustrative embodiments of the invention wherein like reference numbers refer to similar elements throughout the several views and in which.

DETAILED DESCRIPTION OF THE INVENTION

For the purposes of describing the present invention the directional terms frontwardly, sidewardly to the right, sidewardly to the left, and rearwardly will be defined relative to the needle of the sewing machine with the direction determined using the direction of advancement of a garment or fabric, as it is being sewn, as a reference point. Accordingly, the term "frontwardly" of the sewing needle is described as relative to the sewing needle in a direction opposite that of advancement of the garment or fabric, whereas "rearwardly" of the sewing needle is described as relative to the sewing needle in the direction of advancement of the garment or fabric being sewn. Sidewardly to the right or to the left is taken from the perspective of one viewing the sewing needle from the front of the sewing machine.

Figure 1:
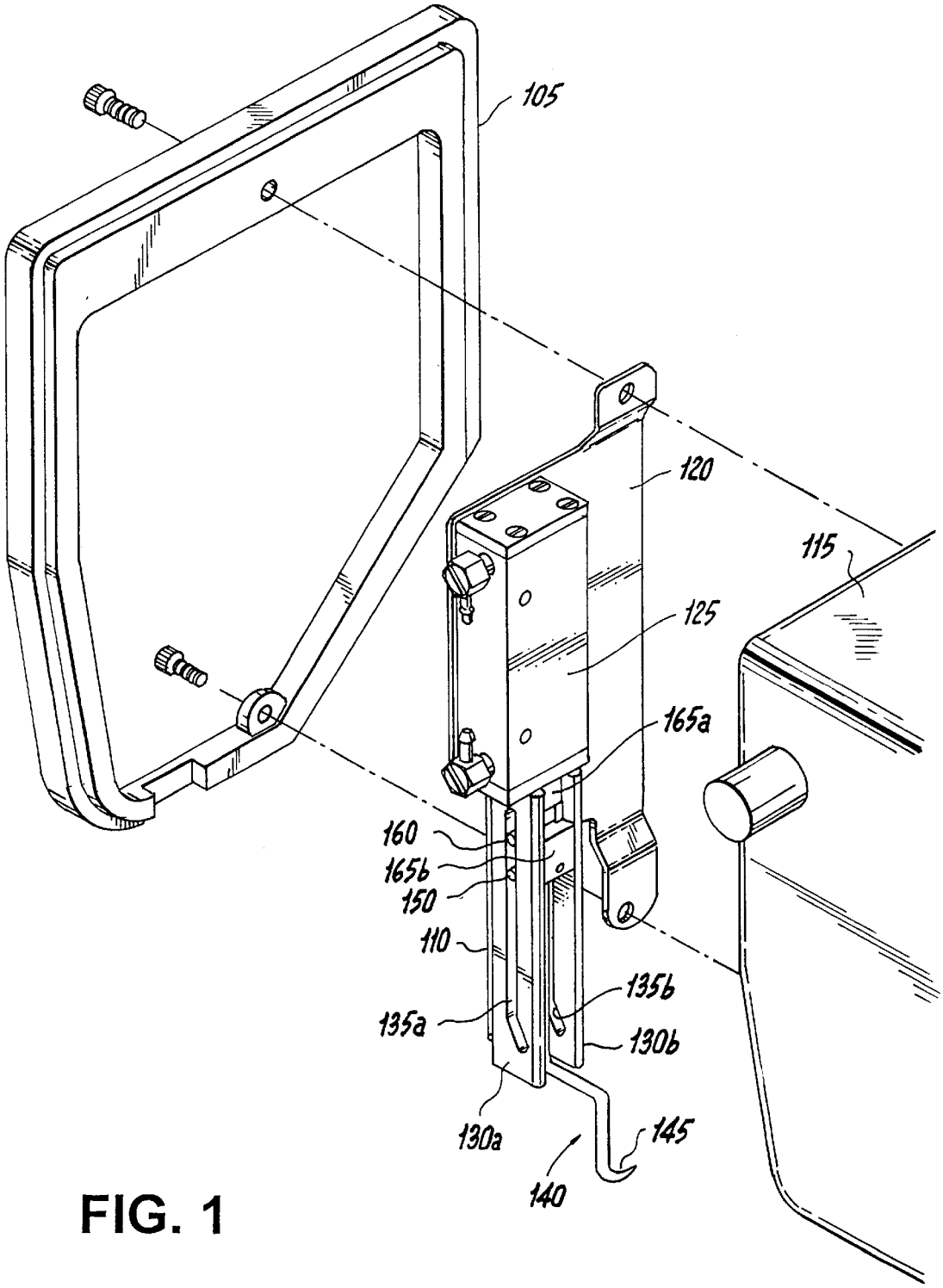
FIG. 1 is an exploded view of the side mounted thread wiper in accordance with the present invention installed in an exemplary heavy duty sewing machine.
Figure 2A:
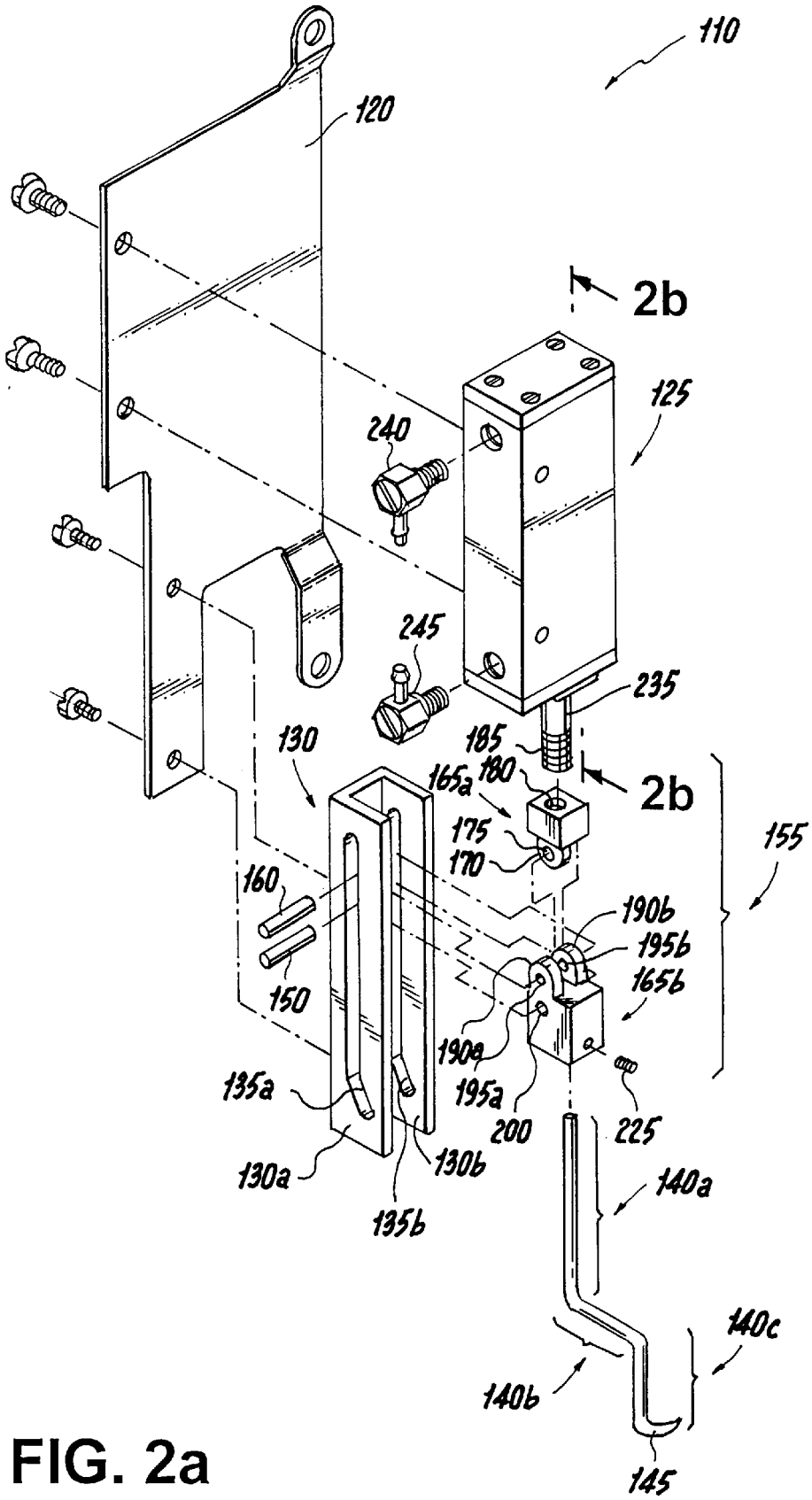
FIG. 2*a* is an exploded view of the side mount thread wiper in FIG. 1.
Figure 2B:
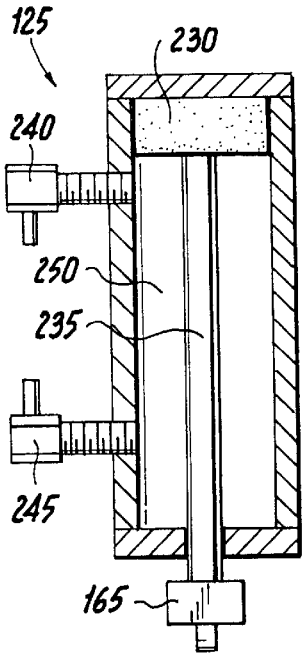
FIG. 2*b* is a longitudinal cross-sectional view of the actuating member of the thread wiper assembly in FIG. 2*a* along line B—B.
Figure 2C:
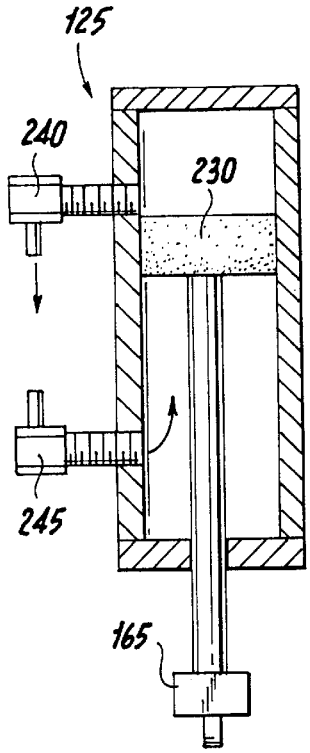
FIGS. 2*c* through 2*e* show displacement of the plunger in the aide mount thread wiper in FIG. 1.
Figure 2D:
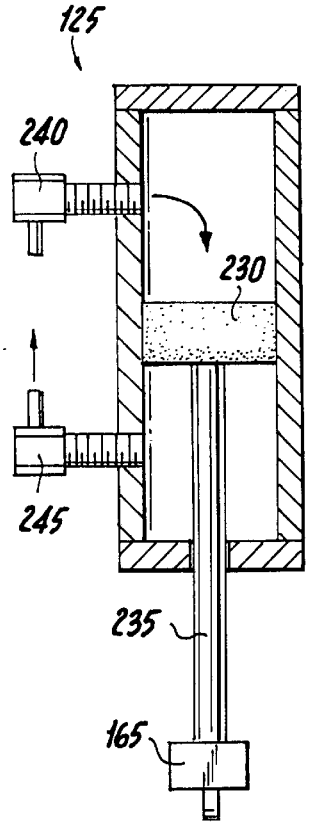
Figure 2E:
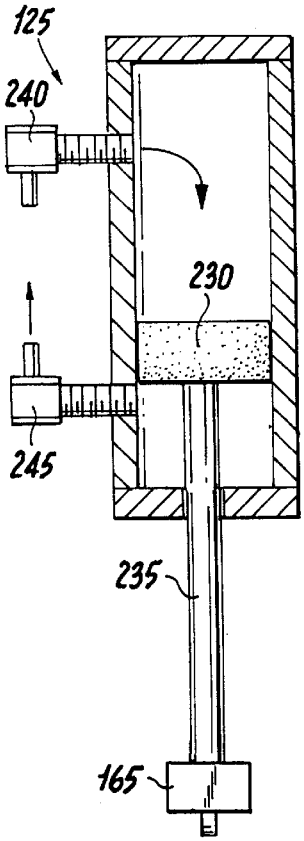

Referring to FIG. 1, thread wiper assembly 110 is mounted to the side of a heavy duty sewing machine 115 having a walking foot (not shown) via a mounting plate 120 and is enclosed or covered by an end face plate or cover 105. FIGS. 2*a* and 2*b* show the thread wiper assembly in accordance with the present invention including an actuating member 125 in which is disposed a plunger or piston 230 having a shaft 235. Plunger 230 is disposed within a longitudinally extending cylindrical bore 250 defined in the actuating member 125. Air fittings 240, 245 are fluidly connected to the cylindrical bore 250. FIGS. 2*c* through 2*e* show the displacement of the plunger 230 in the bore 250. When compressed air is applied to fitting 245, in FIG. 2*c*, plunger 230 is displaced upwards causing the air in the bore 250 to exhaust out through fitting 240. Conversely, when the pressurized air is switched and connected to fitting 240, as shown in FIGS. 2*d* and 2*e*, plunger 230 is displaced downwards in bore 250 and the air is expelled through fitting 245.

Figure 2F:
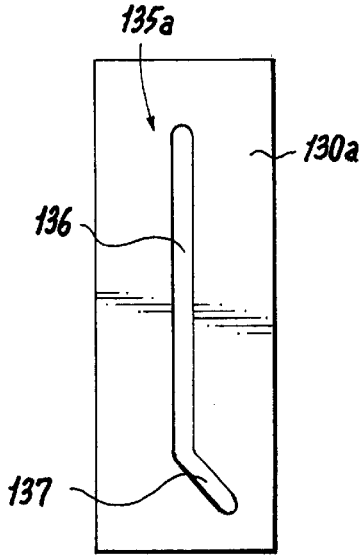
FIG. 2*f* is a side view of the U-shaped track in the side mount thread wiper in FIG. 1.

In FIG. 2*a*, two substantially parallel side arms 130*a*, 130*b* are attached to the mounting plate 120 to form a U-shaped track 130. Each side arm 130*a*, 130*b* has a channel or slot 135*a*, 135*b*, respectively, extending in a longitudinal direction. Channels 135*a*, 135*b* mirror one another, with each channel including a linear section 136 and an angled section 137, as shown in FIG. 2*f*. When the thread wiper assembly 110 is mounted to the sewing machine, the U-shaped track 130 is arranged with the angled section 137 disposed downward to and pointing toward the needle of the sewing machine. Side arms 130*a*, 130*b* are spaced apart so as to receive therebetween a sliding block 155 separated into an upper member 165*a* and a lower member 165*b*. Upper member 165*a* has a threaded hole 180 defined at one end for receiving a threaded end 185 of the shaft 235 of the plunger 230. A tongue 170 projects from an opposite end of the upper member 165*a* and has a bore 175 defined laterally therethrough. Lower member 165*b* of sliding block 155 has two side members 190*a*, 190*b* projecting from one end and separated from one another so as to receive tongue 170. An aperture 195*a*, 195*b* is laterally defined in each side member 190*a*, 190*b*, respectively. A picker arm or retractor 140 is secured to the opposite end of the lower member 165*b* so that the picker arm and the lower member move together. In a preferred embodiment, picker arm 140 is releasably secured to the lower member 165*b*, for example, by a screw 225, so that the picker arm may be replaced.

Upper and lower members 165*a*, 165*b* are secured together by inserting tongue 170 between side members 190*a*, 190*b* and substantially aligning bores 175, 195*a*, 195*b* to receive a securing rod 160 therein. Securing rod 160 extends beyond the width of the upper and lower members 165*a*, 165*b* into the channels 135*a*, 135*b*. Another aperture 200 is defined laterally through the lower member 165*b* of the sliding block 155 for receiving a pin or rod 150 of sufficient length to rest in channels 135*a*, 135*b* of side arms 130*a*, 130*b*. The sliding block 155 comprising upper and lower members 165*a*, 165*b* is displaced within the U-shaped track 130 as the plunger 230 is moved in bore 250 by adjusting the pressure therein. Because the sliding block 155 is divided into upper and lower members 165*a*, 165*b* connected by the securing rod 160, lower member 165*b* may be pivoted about securing rod 160 relative to upper member 165*a*, as described in detail below.

Picker arm or retractor 140 is made of a rigid material, preferably metal, and has a substantially straight upper section 140*a* transitioning at a substantially right angle to an intermediate section 140*b* followed by a lower section 140*c* substantially parallel to the upper section that terminates in the hook 145. Hook 145 projects from a plane defined by upper section 140*a*, intermediate section 140*b*, and lower section 140*c*.

Figure 3:
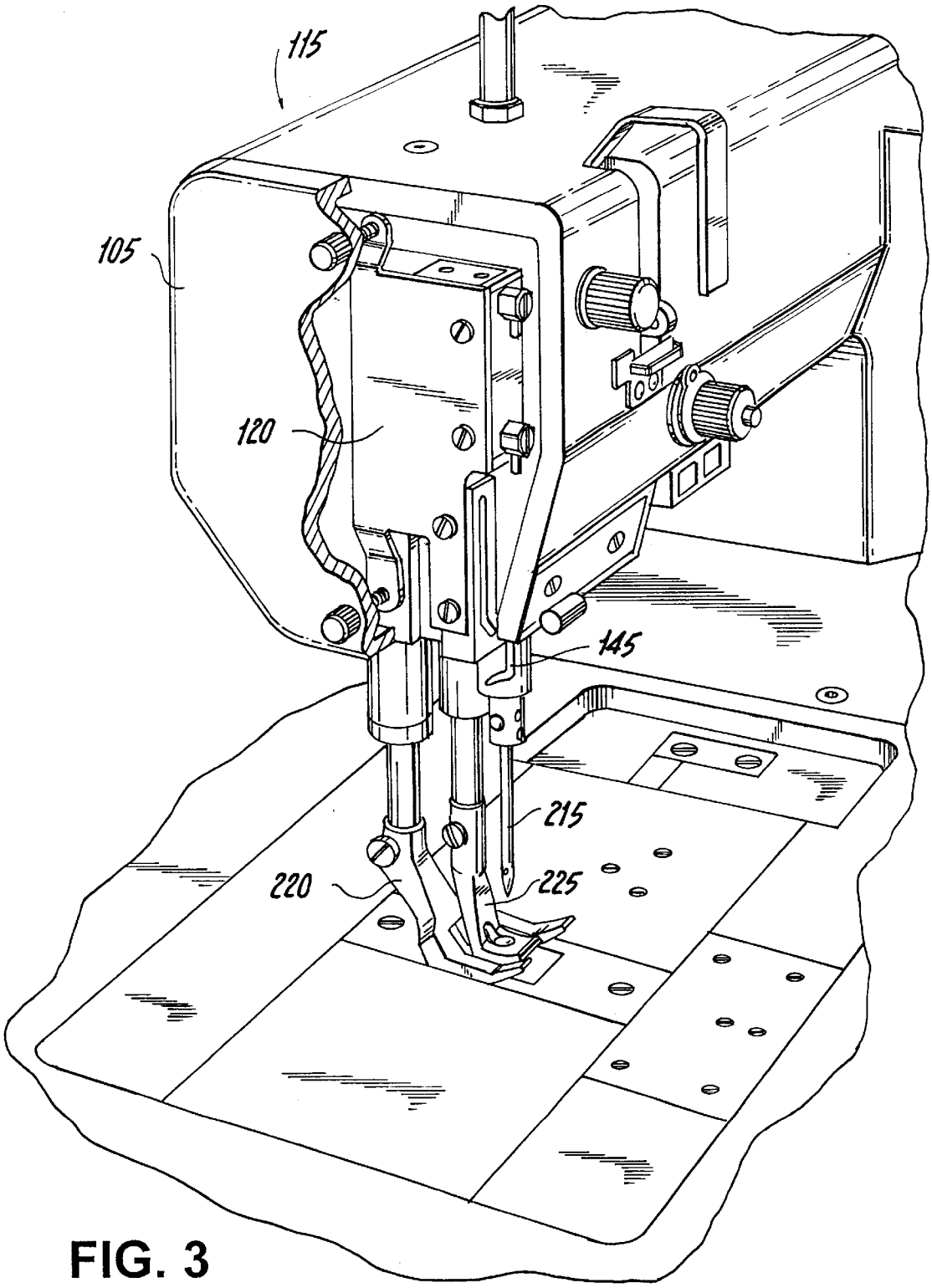
FIG. 3 is a side perspective view an exemplary heavy duty sewing machine with a portion of the face plate removed to reveal the side mount thread wiper installed therein with the picker arm in the raised position.
Figure 4:
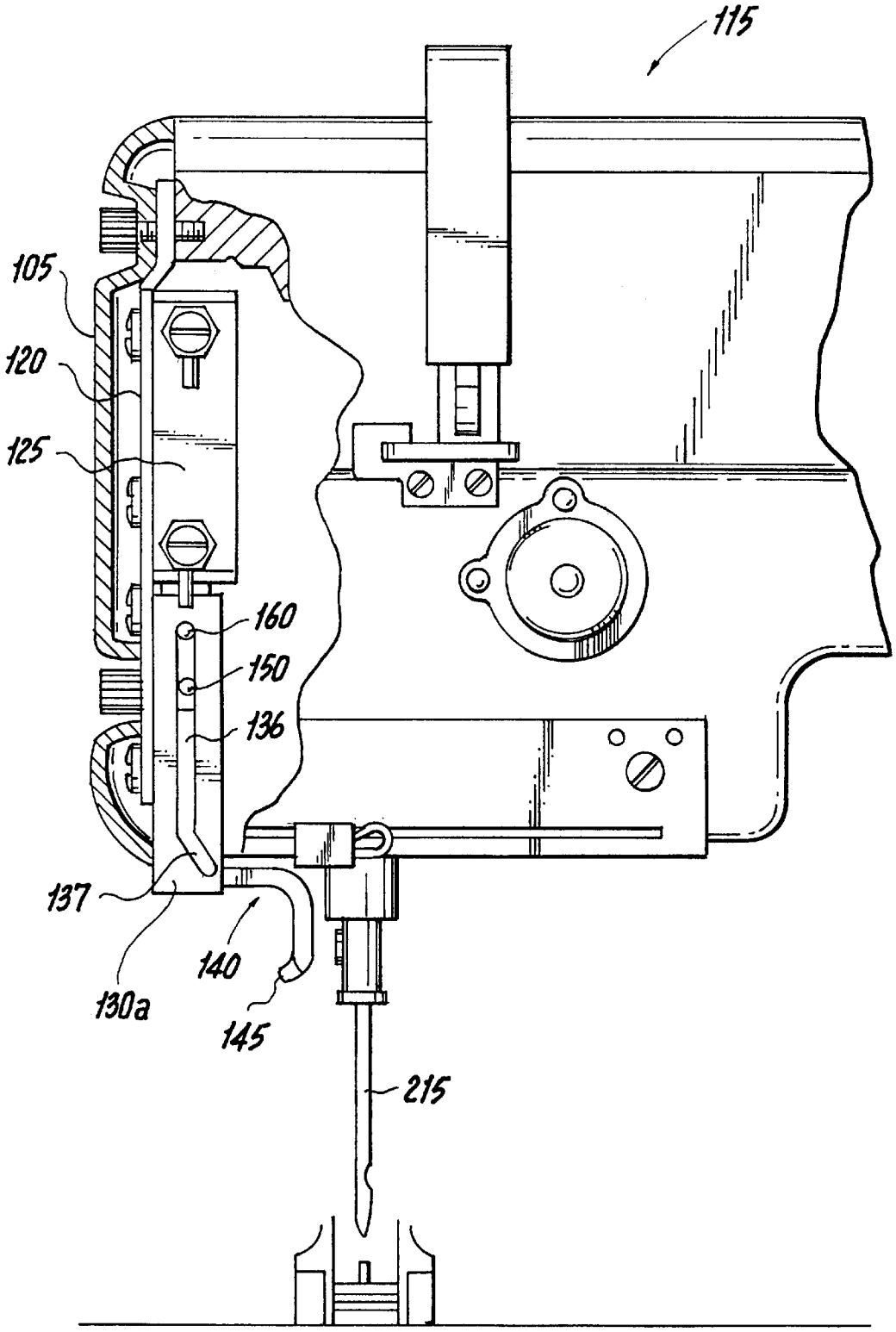
FIG. 4 is a front view of the exemplary heavy duty sewing machine with a portion of the front of the housing removed to reveal the side mount thread wiper installed therein with the picker arm in the raised position.

FIGS. 3 and 4 are side and front views, respectively, of an exemplary heavy duty sewing machine 115 with a portion of the housing removed to reveal the thread wiper assembly 110 installed therein. Sewing machine 115 includes a vertically reciprocating needle 215. A rockable presser foot 220 is mounted rearwardly of the needle 215 and is vertically movable between raised and depressed positions in a known manner. Walking foot 225 is arranged between the needle 215 and presser foot 220. As is clearly shown in the front view of the sewing machine in FIG. 4, the thread wiper assembly 110 is mounted to the side of the needle mechanism. During installation, the thread wiper assembly 110 is arranged so that the linear sections 136 of channels 135*a*, 135*b* are substantially parallel to the needle 215 and the angled sections 137 are directed downward and toward the needle 215.

Figure 5A:
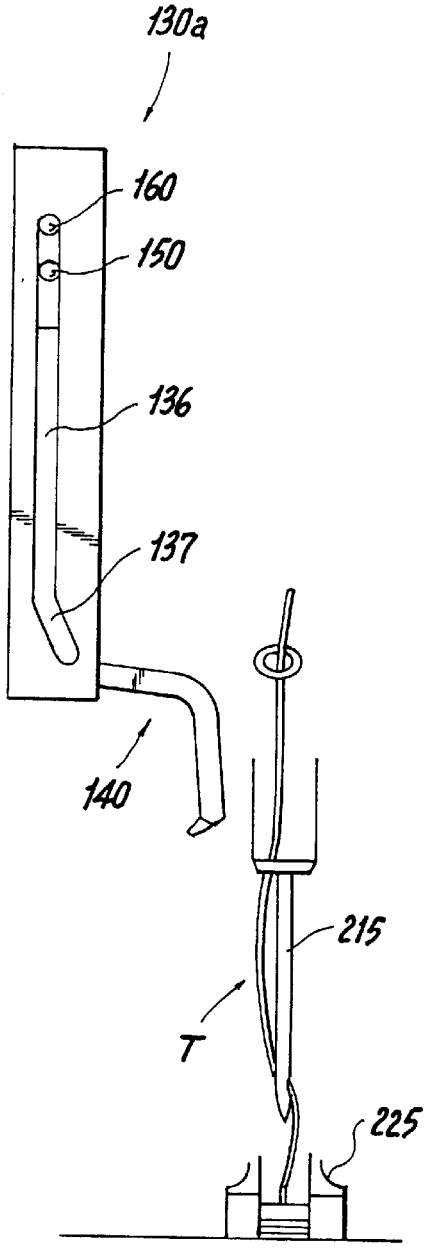
FIGS. 5*a*–5*f* show a sequence of operational steps of the picker arm of the side mount thread wiper relative to the needle of the sewing machine in accordance with the present invention.
Figure 5B:
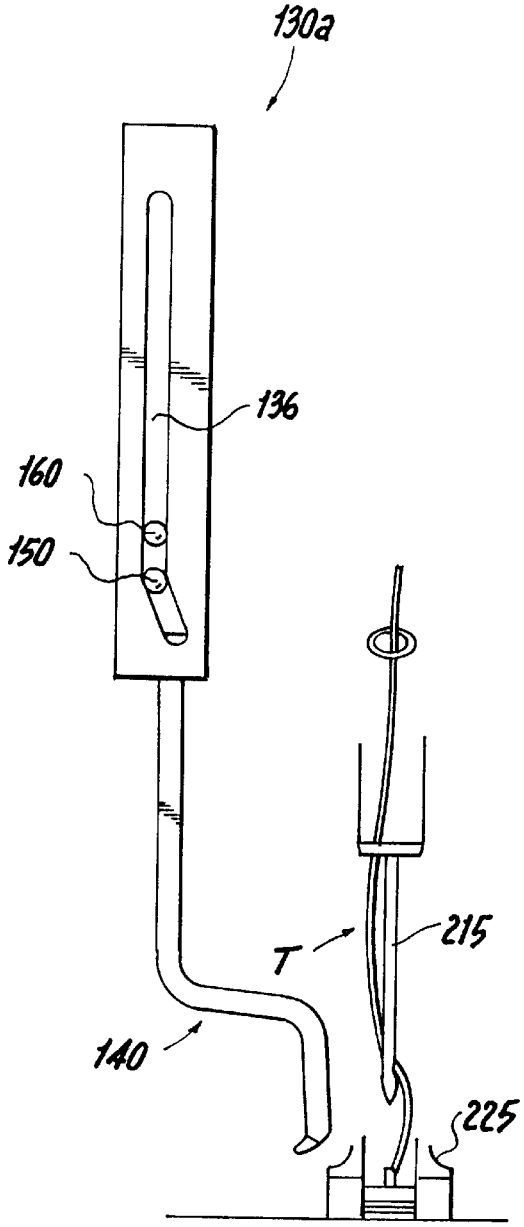
Figure 5C:
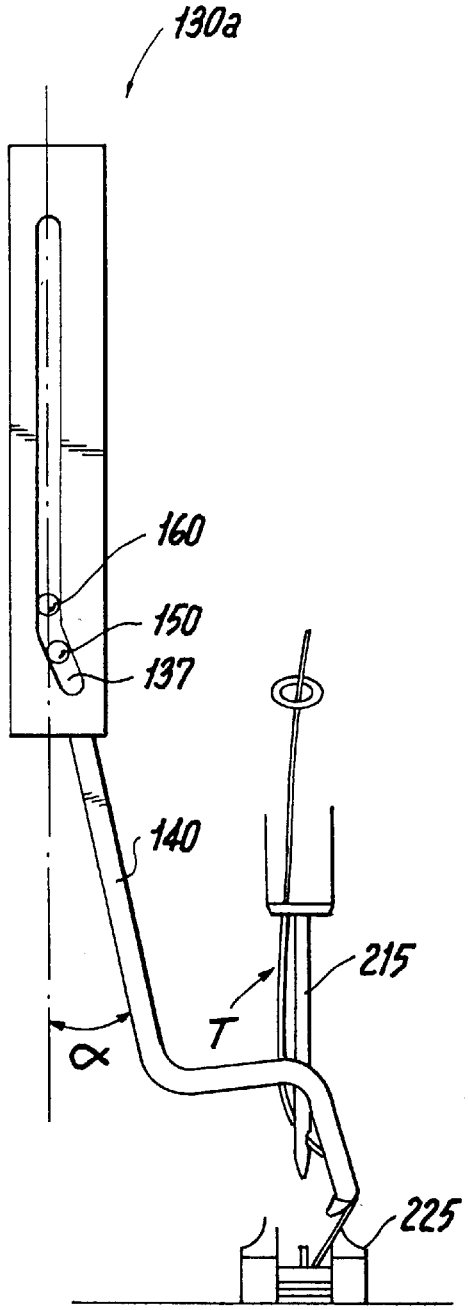
Figure 5D:
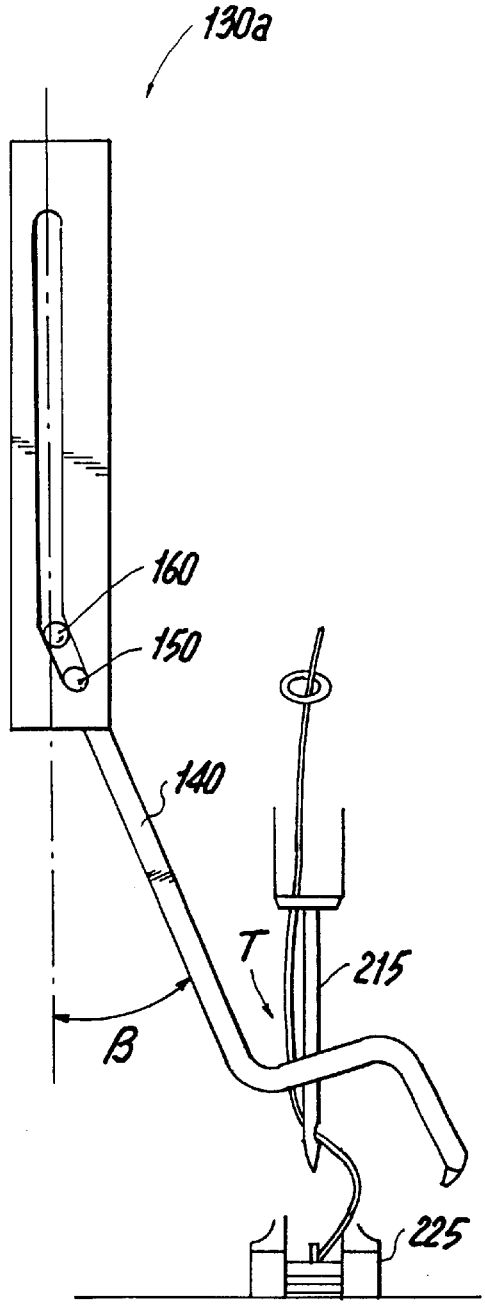

The sequential operation of the thread wiper assembly in accordance with the present invention depicting a simplified partial side view of the picker arm 140 and needle 215, is shown in FIGS. 5*a*–5*f*. During sewing operations pressurized air is connected to fitting 245 so that plunger 230 is retracted to its raised position proximate the top of actuating member 125. Under these conditions, the securing rod 160 registers with the upper terminating end of the channels 135*a*, 135*b*, whereby the picker arm 140 is in a raised position. The thread wiper assembly 110 is therefore totally retracted and out of the way of the needle 215. Upon completion of a sewing operation with the picker arm 140 in its retracted position, needle 215 is stopped in its fully raised position and the thread T is cut either manually or automatically. Thereafter, compressed air is applied to fitting 240. As the pressure in the bore 250 increases the plunger 230 and sliding block 155 connected thereto are displaced vertically downward, as shown in FIG 5*b*, while the securing rod 160 and pin 150 travel along the linear section 136 of the channels 135*a*, 135*b*. FIG. 5*c* shows that the pin 150 thereafter advances to the angled section 137 of the channels 135*a*, 135*b* while the securing rod 160 remains in the linear section 136 of the channels. In this position, the picker arm 140 is thrust at a first angle α, relative to the vertical axis Y, towards the needle 215 pushing the hook 145 against the thread T, thereby laterally displacing a section of the thread T between the needle 215 and walking foot 225 without interference. Thereafter, in FIG. 5*d*, the plunger 230 and sliding block 155 are advanced further downward until pin 150 reaches the terminating end of the angled section 137 of the channels 135*a*, 135*b*, while securing rod 160 transitions from the linear section 136 to the angled section 137 of the channels 135*a*, 135*b*, thereby causing the picker arm 140 to be thrust towards the needle 215 at a second angle β, greater than angle α, as shown in FIG. 5*c*, and freed from the thread T. At this time, the picker arm 140 is lowered to a vertical position between the bottom of the raised needle 215 and the top of the walking foot 225.

Figure 5E:
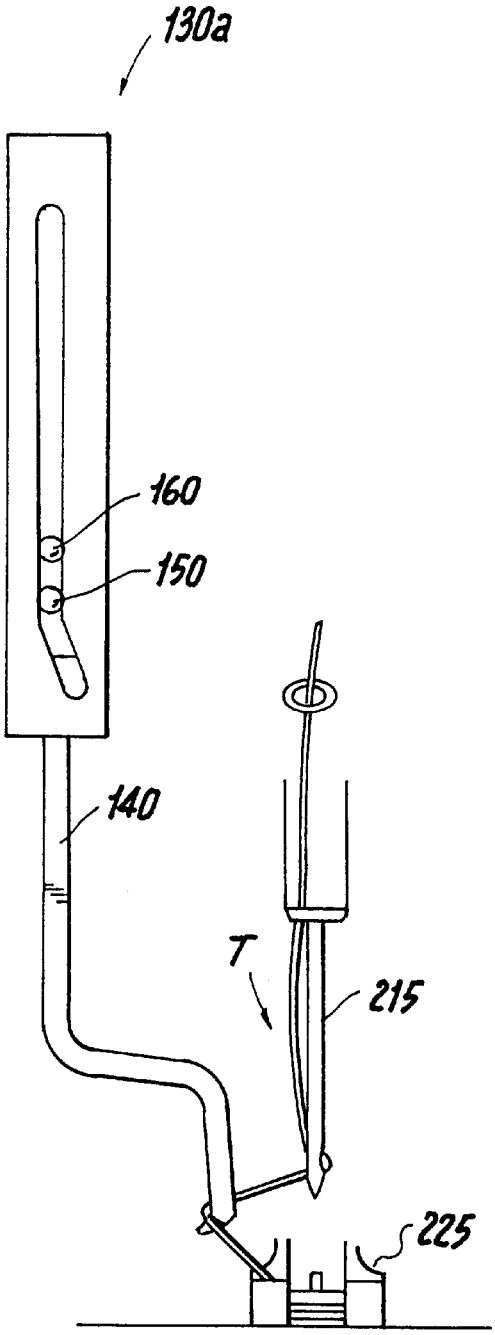
Figure 5F:
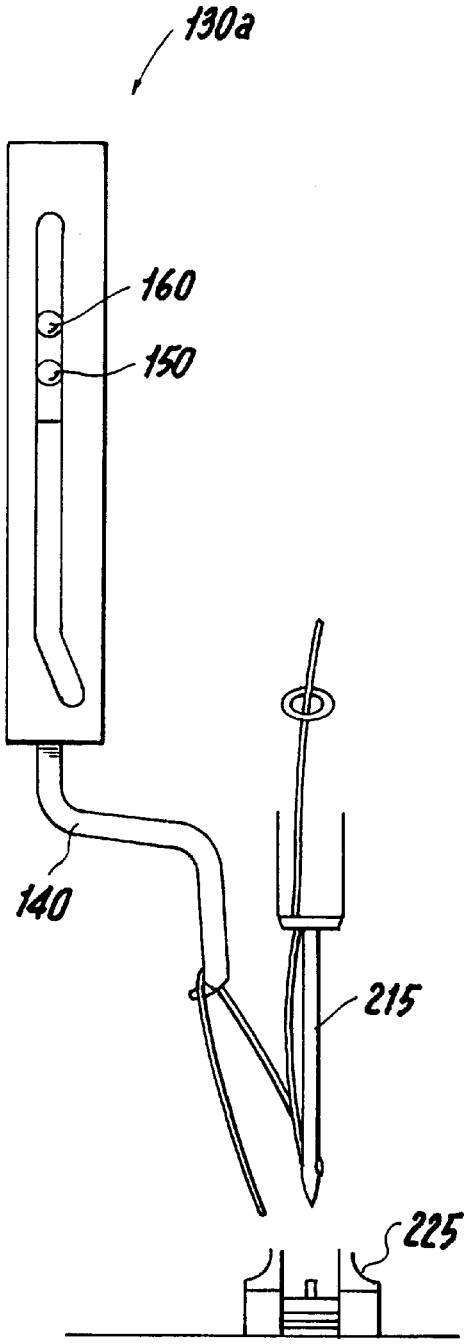

In FIG. 5*e* and 5*f*, pressurized air is applied to fitting 245 to displace the plunger 230 vertically upwards, while causing sliding block 155 and picker arm 140 to be moved away from the needle 215, in a direction of movement opposite that effected with the advance stroke of the plunger. As the of the picker arm 140 advances in a reverse direction to complete the cycle, the hook 145 grasps or catches the excess or loose cut thread T pulling the free end of the thread out from the path of the needle and away from the sewing area of the next work piece.

The linear and angled sections 136, 137 respectively of the channels 135*a*, 135*b*, must be adapted or designed so that when the side mount thread wiper assembly 110 is installed on the sewing machine, the picker arm 140, and in particular, the hook 145, does not interfere with the walking foot 225 or needle 215 while in an extended position. Designing the thread wiper assembly 110 to be mounted to the side of the needle 215 also helps to ensure that the picker arm 140 does not interfere with the walking foot or needle.

Under certain circumstances a thread wiper assembly, such as that described above, may not be operable in a sewing machine. In heavy duty sewing machines having a walking foot, the rise or height of the walking foot is adjustable based on thy thickness of the material or fabric to be sewn. The speed of operation of the sewing machine is inversely proportional to the rise or height of the walking foot, that is, the higher the rise of the walking foot the slower the speed of operation of the sewing machine, and vice versa. It has been recognized that since the rise or height of the walking foot at times may be too great for use of a thread wiper assembly, such as that described above, it is desirable to have an intelligent thread wiper assembly that is automatically disabled when the walking foot setting exceeds a predetermined rise or height, for example, when the walking foot rise is set to more than approximately 50% of the maximum permitted rise.

In yet another situation the thread wiper assembly is preferably disabled when the turn back operation of the sewing machine is disabled or turned off. Turn back operation of a sewing machine raises the needle to its retracted position separated away from the walking foot by a predetermined distance so that the thread wiper assembly described above traverses between the walking foot and needle without interference. Clearly, if the turn back operation is disabled or turned off by the operator the needle will not be raised to its retracted position and there will be little, if any, clearance between the needle and presser foot in a sewing machine that does not have a walking foot, or between the needle and walking foot in a heavy duty sewing machine with a walking foot, to provide sufficient clearance for the picker arm of the thread wiper assembly without interfering with the needle.

To overcome either one or both of these two situations, an intelligent thread wiper assembly including a microprocessor or computer is used. The thread wiper assembly is intelligently enabled/disabled depending on the turn back mode and/or the level of rise of the walking foot. Specifically, the thread wiper operation is disabled or turned off whenever the turn back mode is disabled and/or the rise of the walking foot exceeds a predetermined percentage of the maximum rise. On the other hand, the thread wiper is enabled or turned on when the turn back mode is enabled and the walking foot is set to a rise or height less than or equal to a predetermined acceptable percentage of the maximum rise. In a preferred embodiment, the intelligent thread wiper assembly is enabled/disabled based on both the turn back mode and rise of the walking foot. Alternatively, operation of the thread wiper assembly may be determined based on either one of these factors.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. The side mount thread wiper assembly in accordance with the present invention may also be used in sewing machines that do not have a walking foot. It is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

What is claimed is:

1. An assembly for use with a sewing machine including a needle, comprising:

a thread wiper adapted to be mountable to the side of the sewing machine, said thread wiper including a picker arm displaceable between a retracted position and an extended position, said picker arm is adapted so as not to interfere with the needle and a walking foot of the sewing machine while being displaced.

2. An assembly for use with a sewing machine including a needle, comprising:

a thread wiper adapted to be mountable to the side of the sewing machine, said thread wiper having a sliding block including an upper member and a lower member disposed one atop the other in a substantially vertical direction and pivotable with respect to one another.

3. An assembly in accordance with claim 2, wherein said lower member supports said picker arm.

4. An assembly in accordance with claim 2, wherein said actuating member comprises:

a housing having two fittings;

a plunger disposed in the housing; and a shaft connecting said plunger and said upper member.

5. An assembly for use with a sewing machine including a needle and a walking foot, comprising:

a thread wiper adapted to be mountable to the side of the sewing machine, said thread wiper including a picker arm displaceable between a retracted position and an extended position, said picker arm being adapted so as not to interfere with the needle and the walking foot of the sewing machine while being displaced; and a microprocessor for disabling said thread wiper when at least one of (i) the walking foot is set to a value greater than a predetermined percentage of a maximum permitted rise, and (ii) turn back operation of the sewing machine is disabled.

6. An assembly in accordance with claim 5, wherein the predetermined percentage is approximately 50% of the maximum permitted rise.

7. An assembly for use with a sewing machine including a needle and a walking foot, comprising:

a thread wiper adapted to be mountable to the side of the sewing machine, said thread wiper including a picker arm displaceable between a retracted position and an extended position, said picker arm being adapted so as not to interfere with the needle and the walking foot of the sewing machine while being displaced; and a microprocessor for enabling said thread wiper when the walking foot is set to a value less than a predetermined percentage of a maximum permitted rise and turn back operation of the sewing machine is enabled.

8. An assembly in accordance with claim 7, wherein the predetermined percentage is approximately 50% of the maximum permitted rise.

9. In a sewing machine including a walking foot and a needle reciprocatable along a path between a raised position and a lowered position, a thread wiper mounted sidewardly relative to the needle, said thread wiper assembly comprising:

a picker arm, while in a retracted position, being disposed sidewardly relative to said needle, said picker arm having a terminating free end;

an actuating member supporting said picker arm, said actuating member lowering said picker arm in a direction substantially parallel to said needle until the free end of said picker arm is at a level between the needle and the walking foot; sidewardly thrusting said picker arm at a first angle, relative to a vertical axis, towards the needle along a path between the needle and the walking foot without interference; advancing further sideways said picker arm at a second angle, relative to the vertical axis, greater than the first angle; and retracting away while raising said picker member in a reverse movement to complete the cycle.

10. A thread wiper in accordance with claim 9, further comprising a microprocessor for disabling said thread wiper when at least one of the walking foot is set to a value greater than a predetermined percentage of a maximum permitted rise and turn back operation of the sewing machine is disabled.

11. A thread wiper in accordance with claim 10, wherein the predetermined percentage is approximately 50% of the maximum permitted rise.

12. A thread wiper in accordance with claim 9, further comprising a microprocessor for enabling said thread wiper when the walking foot is set to a value less than a predetermined percentage of a maximum permitted rise and turn back operation of the sewing machine is enabled.

13. A thread wiper in accordance with claim 12, wherein the predetermined percentage is approximately 50% of the maximum permitted rise.

14. In a sewing machine including a presser foot and a needle reciprocatable along a path between a raised position and a lowered position, a thread wiper mounted sidewardly relative to the needle, said thread wiper assembly comprising:

a picker arm while in a retracted position being disposed sidewardly relative to said needle, said picker member having a terminating free end;

an actuating member supporting said picker arm, said actuating member lowering said picker arm in a direction substantially parallel to the needle until the free end of said picker arm is at a level between the presser foot and the needle; sidewardly thrusting said picker arm at a first angle, relative to a vertical axis, towards the needle along a path between the needle and the presser foot without interference; advancing further sideways said picker arm at a second angle, relative to the vertical axis, greater than the first angle; and retracting away and raising said picker arm in a reverse movement to complete the cycle.

15. A method for cyclically operating a thread wiper mounted to a side of a sewing machine having a needle and a walking foot, said thread wiper including a picker arm terminating in a free end, comprising the steps of:

lowering the picker arm in a direction substantially parallel to the needle until the free end of the picker arm is at a level between the needle and the walking foot;

sidewardly thrusting the picker arm at a first angle, relative to a vertical axis, towards the needle along a path between the needle and the walking foot without interference;

advancing the picker arm towards the needle at a second angle, relative to the vertical axis, greater than the first angle; and retracting away while raising the picker arm in a reverse movement to complete the cycle.

16. A method in accordance with claim 15, further comprising disabling said thread wiper when at least one of the walking foot is set to a value greater than a predetermined percentage of a maximum permitted rise and turn back operation of the sewing machine is disabled.

17. A method in accordance with claim 16, wherein the predetermined percentage is approximately 50% of the maximum permitted rise.

18. A method in accordance with claim 15, further comprising enabling said thread wiper when the walking foot is set to a value less than a predetermined percentage of a maximum permitted rise and turn back operation of the sewing machine is enabled.

19. A method in accordance with claim 18, wherein the predetermined percentage is approximately 50% of the maximum permitted rise.

20. A method for cyclically operating a thread wiper side mountable to a sewing machine having a needle and a presser foot, said thread wiper including a picker arm terminating in a free end, comprising the steps of:

lowering the picker arm in a direction substantially parallel to the needle until the free end of the picker arm is at a level between the needle and the presser foot;

sidewardly thrusting the picker arm at a first angle, relative to a vertical axis, towards the needle along a path between the needle and the presser foot without interference;

advancing the picker arm towards the needle at a second angle, relative to the vertical axis, greater than the first angle; and retracting away while raising the picker arm in a reverse movement to complete the cycle.

21. A thread wiper for use with a sewing machine including a walking foot, comprising:

a microprocessor for disabling said thread wiper when at least one of the walking foot is set to a value greater than a predetermined percentage of a maximum permitted rise and turn back operation of the sewing machine is disabled.

22. A thread wiper in accordance with claim 21, wherein the predetermined percentage is approximately 50% of the maximum permitted rise.

23. A thread wiper for use with a sewing machine including a walking foot, comprising:

a microprocessor for enabling said thread wiper when the walking foot is set to a value less than a predetermined percentage of a maximum permitted rise and turn back operation of the sewing machine is enabled.

24. A thread wiper in accordance with claim 23, wherein the predetermined percentage is approximately 50% of the maximum permitted rise.

25. A method for using a thread wiper installed in a sewing machine having a needle and a walking foot, comprising the step of:

disabling said thread wiper when at least one of the walking foot is set to a value greater than a predetermined percentage of a maximum permitted rise and turn back operation of the sewing machine is disabled.

26. A method in accordance with claim 25, Wherein the predetermined percentage is approximately 50% of the maximum permitted rise.

27. A method for using a thread wiper installed in a sewing machine having a needle and a walking foot, comprising the step of:

enabling said thread wiper when the walking foot is set to a value less than a predetermined percentage of a maximum permitted rise and turn back operation of the sewing machine is enabled.

28. A method in accordance with claim 27, wherein the predetermined percentage is approximately 50% of the maximum permitted rise.

29. A sewing machine comprising:

a needle;

a walking foot;

a thread wiper mountable sidewardly relative to said needle and adapted so as not to interfere with said needle, said thread wiper including a picker arm displaceable between a retracted position and an extended position, said picker arm is adapted so as not to interfere with said needle and said walking foot.

30. A sewing machine in accordance with claim 29, further comprising a mounting plate by which said thread wiper is mountable to the side of the sewing machine.

31. A sewing machine in accordance with claim 29, wherein said thread wiper comprises a track including two substantially planar side arms, each side arm having a channel defined therethrough.

32. A sewing machine in accordance with claim 31, wherein each channel comprises a linear section and an angled section, said track being oriented so that the linear section is arranged substantially parallel to said needle of the sewing machine and the angled section is disposed downward and directed toward said needle.

33. A sewing machine in accordance with claim 31, said thread wiper further comprising a sliding block displaceable in said track.

34. A sewing machine in accordance with claim 33, wherein said sliding block comprises an upper member and a lower member pivotable with respect to one another.

35. A sewing machine in accordance with claim 34, wherein said lower member supports said picker arm.

36. A sewing machine in accordance with claim 34, wherein said thread wiper further comprises an actuating member for displacing said sliding block in said track.

37. A sewing machine in accordance with claim 36, wherein said actuating member comprises:

a housing having two fittings;

a plunger disposed in the housing; and a shaft connecting said plunger and said upper member.

38. A sewing machine in accordance with claim 29, further comprising a microprocessor for disabling said thread wiper when at least one of the walking foot is set to a value greater than a predetermined percentage of a maximum rise and turn back operation of the sewing machine is disabled.

39. A sewing machine in accordance with claim 38, wherein the predetermined percentage is approximately 50% of the maximum permitted rise.

40. A sewing machine in accordance with claim 29, further comprising a microprocessor for disabling said thread wiper when turn back operation of the sewing machine is disabled.

41. A sewing machine in accordance with claim 29, further comprising a microprocessor for enabling said thread wiper when the walking foot is set to a value less than a predetermined percentage of a maximum permitted rise and turn back operation of the sewing machine is enabled.

42. An assembly in accordance with claim 41, wherein the predetermined percentage is approximately 50% of the maximum permitted rise.

* * * * *

UNITED STATES PATENT AND TRADEMARK OFFICE

CERTIFICATE OF CORRECTION

PATENT NO. : 6,568,339 B1 
DATED : May 27, 2003
INVENTOR(S) : Kirk B. Campbell et al.

It is certified that error appears in the above-identified patent and that said Letters Patent is hereby corrected as shown below:

Title page,
Item [73], Assignee, delete "Clinton Indusries, Inc." and substitute with
-- Clinton Industries, Inc. --

Signed and Sealed this

Twenty-sixth Day of August, 2003

JAMES E. ROGAN
*Director of the United States Patent and Trademark Office*